US005236816A

United States Patent [19]

Purol et al.

[11] Patent Number: 5,236,816

[45] Date of Patent: Aug. 17, 1993

[54] PHOTOGRAPHIC DEVELOPING SOLUTION AND USE THEREOF IN THE HIGH CONTRAST DEVELOPMENT OF NUCLEATED PHOTOGRAPHIC ELEMENTS

[75] Inventors: Michael D. Purol; Paul A. Zielinski; Donald L. Kerr, all of Rochester, N.Y.

[73] Assignee: Eastman Kodak Company, Rochester, N.Y.

[21] Appl. No.: 866,604

[22] Filed: Apr. 10, 1992

[51] Int. Cl.[5] ..... G03C 5/30

[52] U.S. Cl. ..... 430/492; 430/435; 430/436; 430/440; 430/441; 430/478; 430/480

[58] Field of Search ..... 430/435, 436, 440, 441, 430/464, 480, 478, 483, 489, 490, 492

[56] References Cited

U.S. PATENT DOCUMENTS

| | | | |
|---|---|---|---|
| 2,688,548 | 3/1954 | Reynolds et al. | 430/480 |
| 2,688,549 | 7/1954 | James et al. | 430/480 |
| 3,022,168 | 11/1962 | Stjarnkvist | 430/478 |
| 3,512,981 | 2/1970 | Prchal et al. | 430/265 |
| 3,870,479 | 6/1975 | Kubotera et al. | 430/204 |
| 3,942,985 | 5/1976 | Newman et al. | 430/479 |
| 4,478,928 | 4/1984 | Hess et al. | 430/217 |
| 4,650,746 | 12/1987 | Simson et al. | 430/438 |
| 4,975,354 | 11/1990 | Machonkin et al. | 430/264 |
| 5,098,819 | 3/1992 | Knapp | 430/436 |

FOREIGN PATENT DOCUMENTS

| | | |
|---|---|---|
| 70070/91 | 1/1991 | Australia . |
| 2035049 | 8/1991 | Canada . |

*Primary Examiner*—Hoa Van Le

*Attorney, Agent, or Firm*—Alfred P. Lorenzo

[57] ABSTRACT

An improved photographic developing solution is free of dihydroxybenzene developing agents such as hydroquinone, has a pH in the range of from 9.5 to 11.5 and comprises (1) an ascorbic acid developing agent, (2) an auxiliary super-additive developing agent and (3) a carbonate buffering agent in a concentration of at least 0.5 molar. The developing solution is broadly useful in black-and-white development but is most advantageously employed in a process for forming a high-contrast image utilizing a silver halide photographic element comprising a hydrazine compound which functions as a nucleating agent and an amino compound which functions as an incorporated booster. The developing solution is ecologically advantageous, exhibits excellent stability with respect to seasoning effects, and provides high speed and good upper scale contrast combined with a low level of pepper fog and a moderate degree of chemical spread.

20 Claims, No Drawings

PHOTOGRAPHIC DEVELOPING SOLUTION AND USE THEREOF IN THE HIGH CONTRAST DEVELOPMENT OF NUCLEATED PHOTOGRAPHIC ELEMENTS

FIELD OF THE INVENTION

This invention relates in general to photography and in particular to the development of silver halide photographic elements. More specifically, this invention relates to an improved black-and-white photographic developing solution and to use of such solution in an improved process for the development of nucleated silver halide photographic elements which are capable of high-contrast development and, in consequence, are especially useful in the field of graphic arts.

BACKGROUND OF THE INVENTION

U.S. Pat. No. 4,975,354 issued Dec. 4, 1990, entitled "Photographic Element Comprising An Ethyleneoxy-Substituted Amino Compound And Process Adapted To Provide High Contrast Development", by Harold I. Machonkin and Donald L. Kerr, describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers.

Other patents describing silver halide photographic elements comprising a hydrazine compound which functions as a nucleator and an amino compound which functions as an incorporated booster include U.S. Pat. No. 4,914,003 and U.S. Pat. No. 5,030,547.

High-contrast photographic elements of the type described hereinabove are typically processed in aqueous alkaline developing solutions containing a dihydroxybenzene developing agent, such as hydroquinone, and an auxiliary super-additive developing agent. Examples of useful auxiliary super-additive developing agents are aminophenols and 3-pyrazolidones. Thus, for example, in the working examples of U.S. Pat. No. 4,975,354, the developing solution comprises hydroquinone and 1-phenyl-4-hydroxymethyl-4-methyl-3-pyrazolidone and in the working examples of U.S. Pat. No. 4,914,003 and U.S. Pat. No. 5,030,547 the developing solution comprises hydroquinone and N-methyl-p-aminophenol.

While development processes based on the use of hydroquinone generally provide very good results with high contrast elements containing both a hydrazine compound and an amino compound, they are disadvantageous with regard to ecological and environmental considerations. In particular, hydroquinone and its derivatives, and the oxidized forms thereof, have become of increasing concern in recent years from the point of view of potential toxicity and environmental pollution. Thus, there is an urgent need in the art for a development process, useful with such elements, which utilizes a developing solution that is highly stable, which exhibits high developing capacity, which does not promote excessive generation of pepper fog, which is resistant to silver sludging and which otherwise meets all the needs of this art, yet which is more ecologically favorable than the developing solutions utilized heretofore because it does not require the use of hydroquinone.

A variety of black-and-white development processes utilizing hydroquinone are currently in commercial use. These range in complexity from simple rapid-access processing—where development of the exposed grains is carried to completion via direct reduction by the developing agent—to more complicated ultra-high-contrast graphic arts processes. For example, contrast enhancement for graphic arts applications can be achieved by development of originally unexposed silver halide grains through a series of imagewise, nucleator-driven fogging reactions. In these more complex, ultra-high-contrast processes, hydroquinone plays key roles beyond the direct reduction of silver halide to metallic silver. For example, at the pH level of 10.0 to 10.5 typically employed in ultra-high-contrast development processes, deprotonation of hydroquinone is such that significant buffering of the developing solution comes from the hydroquinone itself It is also well known that aerial oxidation of hydroquinone, and subsequent sulfonation of oxidized hydroquinone, results in a pH increase. On the other hand, development of silver halide by hydroquinone has the effect of lowering pH. Thus, a hydroquinone developer may show either a pH rise or a pH decrease with practical seasoning; with the amount of the pH shift depending on the balance between the amount of hydroquinone that is aerially oxidized versus the amount of hydroquinone oxidized by the development of silver halide. Developing solutions containing hydroquinone thus offer the potential, at least, of maintaining a stable pH position with seasoning.

A significant level of sulfite is required in developing solutions containing hydroquinone, generally two to three times the molar level of hydroquinone is recommended. Sulfite helps to reduce the rate of aerial oxidation and removes colored oxidation products of hydroquinone by means of sulfonation reactions. Sulfite lowers the rate of aerial oxidation of hydroquinone by the scavenging of reactive intermediates and by an equally important effect of decreasing oxygen solubility and thereby lowering the rate of reaction between oxygen and hydroquinone.

From the above discussion, it is apparent that the role of hydroquinone in the development of nucleated high contrast photographic elements is a complex one and equally apparent that it is very difficult indeed to meet the needs of this art with a developing solution that is free of hydroquinone.

It is toward the objective of providing an improved developing solution, and an improved process for the high-contrast development of nucleated photographic elements, that the present invention is directed.

SUMMARY OF THE INVENTION

This invention provides an aqueous alkaline photographic developing solution that is free of dihydroxybenzene developing agents, such as hydroquinone; that has a pH in the range of from 9.5 to 11.5; and that comprises (1) an ascorbic acid developing agent, (2) an auxiliary super-additive developing agent, and (3) a carbonate buffering agent in a concentration of at least 0.5 molar.

The invention also includes within its scope a process for forming a high-contrast photographic age comprising the steps of (1) imagewise exposing a silver halide photographic element and (2) developing the exposed element with an aqueous alkaline developing solution, wherein the photographic element contains a hydrazine compound which functions as a nucleating agent and an amino compound which functions as an incorporated booster and wherein the developing solution is free of dihydroxybenzene developing agents, has a pH in the range of from 9.5 to 11.5 and comprises (1) an ascorbic acid developing agent, (2) an auxiliary super-additive developing agent and (3) a carbonate buffering agent in a concentration of at least 0.5 molar.

While the novel developing solutions of this invention are especially useful with nucleated photographic elements of the type described in U.S. Pat. No. 4,975,354, they can also be used with non-nucleated photographic elements and will provide results with such non-nucleated elements that are comparable to those obtained with developing solutions containing a dihydroxybenzene developing agent such as hydroquinone.

As hereinafter described in more detail, a key feature of the novel developing solution of this invention is the use of a carbonate buffering agent in a concentration of at least 0.5 molar. While the essential components of the developing solution are the ascorbic acid developing agent, the auxiliary super-additive developing agent and the carbonate buffering agent in a concentration of at least 0.5 molar, sulfite can also be included in the developing solution and is a preferred but optional component. The photographic developing solution disclosed and claimed herein, which is characterized by a concentration of carbonate buffering agent of at least 0.5 molar, is a working strength developing solution, i.e., the reference to a carbonate buffering agent concentration of at least 0.5 molar refers to concentration in a working strength solution and not in a concentrate which is intended to be diluted for use.

In contrast with hydroquinone, ascorbic acid developing agents do not contribute significantly to buffering of pH 10.0 to 10.5 developing solutions. Hydroquinone has a pKa of 9.9 so that it is able to contribute significantly to buffering of a pH 10.0 to 10.5 developing solution. However, ascorbic acid has a pKa of 11.4 and this precludes significant contribution to the buffering of such developing solutions. Also unlike hydroquinone, the by-products of ascorbic acid are non-sulfonating lower molecular weight acids that tend to lower pH. Development of silver halide by ascorbic acid also has the effect of lowering pH so that practical seasoning of an ascorbic acid developer in a processing machine will always tend to produce a pH drop from the combination of aerial oxidation and film development load.

To compensate for the lack of buffering, as compared to hydroquinone, and to minimize the pH decrease with seasoning, the developing solutions of this invention contain a high level of carbonate buffering agent, i.e., they are high ionic strength solutions. The high content of carbonate buffering agent decreases oxygen solubility and thereby lowers the rate of reaction between oxygen and the ascorbic acid developing agent. It is because of this that sulfite is not required to bring about a decrease in oxygen solubility as is the case with hydroquinone. Moreover, the oxidation products of ascorbic acid are colorless and therefor require no analogous scavenging action as is required with hydroquinone. For these reasons, sulfite can be omitted from the developing solutions of this invention, although it is preferred to include at least a small amount of sulfite to serve as an anti-oxidant. The high concentration of carbonate buffering agent that is characteristic of the developing solutions of this invention provides both aeration protection and excellent buffer capacity.

DESCRIPTION OF THE PREFERRED EMBODIMENTS

In the field of graphic arts, it has long been known to achieve high contrast by the use of low sulfite "lith" developers. In conventional "lith" developers, high contrast is achieved using the "lith effect" (also referred to as infectious development) as described by J. A. C. Yule in the Journal of the Franklin Institute, Vol. 239, 221-230 (1945). This type of development is believed to proceed autocatalytically. To achieve "lith effect" development, a low, but critical concentration of free sulfite ion is maintained by use of an aldehyde bisulfite adduct, such as sodium formaldehyde bisulfite, which, in effect, acts as a sulfite ion buffer. The low sulfite ion concentration is necessary to avoid interference with the accumulation of developing agent oxidation products, since such interference can result in prevention of infectious development. The developer typically contains only a single type of developing agent, namely, a developing agent of the dihydroxybenzene type, such as hydroquinone.

Photographic elements utilizing a hydrazine compound that functions as a nucleating agent are not ordinarily processed in conventional "lith" developers but in developers that contain substantially higher amounts of sulfite as described, for example, in such Patents as U.S. Pat. Nos. 4,269,929, 4,914,003, 4,975,354 and 5,030,547.

As explained hereinabove, the novel developing solutions of this invention are not critically dependent on the use of sulfite, although it is preferred that a sulfite preservative be included in the solution at a moderate level. Too high a sulfite concentration is undesirable as it can cause a loss in upper scale contrast and/or a loss in speed. Since they are not critically dependent on the use of sulfite, the developing solutions of this invention are distinct from both conventional "lith" developers and from the type of developing solutions used heretofore with nucleated high-contrast elements.

Ascorbic acid developing agents have been utilized heretofore in a wide variety of photographic developing processes. Thus, for example, U.S. Pat. Nos. 2,688,548 and 2,688,549 disclose developing compositions containing ascorbic acid developing agents and 3-pyrazolidone developing agents; U.S. Pat. No. 3,022,168 discloses developing compositions containing ascorbic acid developing agents and activating developers such as N-methyl-p-aminophenol; U.S. Pat. No. 3,512,981 discloses developing compositions containing a dihydroxybenzene developing agent such as hydroquinone, a sulfite and an ascorbic acid developing agent; U.S. Pat. No. 3,870,479 discloses a lithographic-type diffusion transfer developer containing an ascorbic acid developing agent; U.S. Pat. No. 3,942,985 describes developing solutions containing an ascorbic acid developing agent and an iron chelate developer; U.S. Pat. Nos. 4,168,977, 4,478,928 and 4,650,746 disclose the use of an ascorbic acid developing agent in processes in which a high contrast photographic element is developed in the presence of a hydrazine compound; U.S.

Pat. Nos. 4,839,259 and 4,997,743 disclose high contrast photographic elements containing a hydrazine compound and an incorporated ascorbic acid developing agent, and U.S. Pat. No. 4,975,354 discloses the use of an ascorbic acid developing agent in developing high contrast photographic elements containing both a hydrazine compound that functions as a nucleating agent and an amino compound that functions as an incorporated booster.

Developing solutions containing an ascorbic acid developing agent, a 3-pyrazolidone developing agent, a sulfite preservative, such as sodium sulfite, and an alkaline buffering agent, such as sodium carbonate, are specifically described in U.S. Pat. Nos. 2,688,548 and 2,688,549. Developing solutions containing these same components are also described in Australian Patent Application No. 70070/91, published Aug. 1, 1991, and in corresponding Canadian Patent Application No. 2,035,049, published Aug. 1, 1991. However, the developing solutions of U.S. Pat. No. 2,688,548, U.S. Pat. No. 2,688,549, Australian Patent Application 70070/91 and Canadian Patent Application 2,035,049 are solutions of low ionic strength and, in consequence, are lacking in stability and particularly lacking in stability as it relates to seasoning. Thus, for example, U.S. Pat. Nos. 2,688,548 and 2,688,549 disclose developing solutions containing 25 grams per liter of sodium carbonate, whereas Australian Patent Application 70070/91 and Canadian Patent Application 2,035,049 disclose developing solutions containing 15 to 30 grams per liter of sodium carbonate or potassium carbonate. In marked contrast, the novel developing solutions of this invention are high ionic strength solutions containing a carbonate buffering agent at a concentration of at least 0.5 molar, which corresponds, for example, to at least 53 grams per liter of sodium carbonate ($Na_2CO_3$) and at least 69 grams per liter of potassium carbonate ($K_2CO_3$). The high concentration of carbonate buffering agent utilized in the novel developing solutions of this invention provides a high degree of pH buffering and also provides aeration protection via reduced oxygen solubility in the developing solution.

Photographic systems depending on the conjoint action of a hydrazine compound that functions as a nucleating agent and an amino compound that functions as an incorporated booster are exceedingly complex and their successful utilization is critically dependent on being able to adequately control numerous properties including speed, contrast, dot quality, pepper fog, image spread, discrimination and practical density point. Such systems are strongly influenced not only by the composition of the photographic element but by the composition of the developing solution and by such factors as development pH, development time and development temperature.

The goal of achieving low pepper fog is one which is exceptionally difficult to achieve without sacrificing other desired properties such as speed and contrast. (The term "pepper fog" is commonly utilized in the photographic art, and refers to fog of a type characterized by numerous fine black specks). A particularly important film property is "discrimination", a term which is used to describe the ratio of the extent of shoulder development to pepper fog level. Good discrimination, i.e., full shoulder development with low pepper fog, is necessary to obtain good halftone dot quality.

Any significant level of pepper fog is highly undesirable Image spread is an additional undesirable consequence of the autocatalytic nucleation process. Development within an area of exposure, such as a halftone dot or a line, triggers nucleation at the dot or line edge to cause the dot or line to increase in size. The nucleated development outside the original exposed area, in turn, triggers further nucleation and the growth process continues with time of development at essentially a constant rate.

As shown by the working examples provided herein, the developing solutions of this invention provide important unexpected advantages in processing nucleated high contrast films of the type described in U.S. Pat. No. 4,975,354. As compared with conventional hydroquinone developers, they provide faster speed and higher practical density point, both of which are desirable features, and they also provide lower levels of the two undesirable features of nucleated development, namely pepper fog and chemical spread. The developing solutions of this invention are also advantageous in that they exhibit a low degree of pH sensitivity and a low degree of sensitivity to bromide concentration. These are critically important features in providing stable long-term operation of a process without undue deterioration in performance as a result of seasoning effects.

While the use of ascorbic acid developing agents in black-and-white photography has long been known, it was not known heretofore that ascorbic acid developing agents could be utilized in developing solutions as described herein to provide improved properties in the development of nucleated high contrast photographic elements employed in the field of graphic arts. The advantages of the developing solutions of this invention, compared to developing solutions containing hydroquinone, are unexpected and surprising. Not only are the developing solutions of this invention advantageous from an ecological standpoint—because they eliminate the need to use hydroquinone—but they are also advantageous in providing the various benefits described hereinabove.

Any hydrazine compound that functions as a nucleator, is capable of being incorporated in the photographic element, and is capable of acting conjointly with the incorporated booster to provide high contrast, can be used in the practice of this invention. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers An especially preferred class of hydrazine compounds for use in the elements of this invention are the hydrazine compounds described in Machonkin et al, U.S. Pat. No. 4,912,016 issued Mar. 27, 1990. These compounds are aryl hydrazides of the formula:

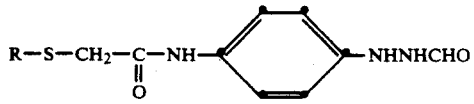

where R is an alkyl or cycloalkyl group.

Another especially preferred class of hydrazine compounds for use in the elements of this invention are the hydrazine compounds described in copending commonly assigned U.S. patent application Ser. No. 167,814, "High Contrast Photographic Element and Emulsion And Process For Their Use", by J. J. Looker, R. E. Leone and L. J. Fleckenstein, filed Mar. 14, 1988 and issued Apr. 14, 1992, as U.S. Pat. No. 5,104,769. The disclosure of this application is incorporated herein by reference in its entirety.

The hydrazine compounds described in the aforesaid patent application Ser. No. 167,814 have one of the following structural formulae:

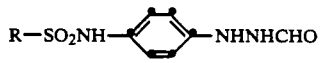

I or

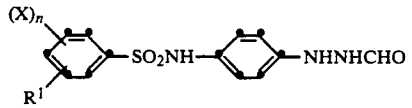

II wherein:

R is alkyl having from 6 to 18 carbon atoms or a heterocyclic ring having 5 or 6 ring atoms, including ring atoms of sulfur or oxygen;

$R^1$ alkyl or alkoxy having from 1 to 12 carbon atoms;

X is alkyl, thioalkyl or alkoxy having from 1 to about 5 carbon atoms; halogen; or —$NHCOR^2$, —$NHSO_2R^2$, —$CONR^2R^3$ or —$SO_2NR^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or —$NHCOR^2$ or —$NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or —$NHCOR^2$— or —$NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it ay be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

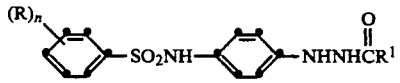

II where each R is a monovalent group comprised of at least three repeating ethyleneoxy units, n is 1 to 3, and $R^1$ is hydrogen or a blocking group.

These hydrazides are described in Machonkin and Kerr, U.S. Pat. No. 5,041,355, issued Aug. 20, 1991.

Still another especially preferred class of hydrazine compounds are the compounds described in Machonkin and Kerr, U.S. Pat. No. 4,988,604 issued Jan. 29, 1991. These compounds are aryl sulfonamidophenyl hydrazides containing both thio and ethyleneoxy groups which have the formula:

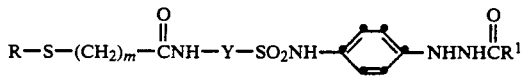

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

A still further especially preferred class of hydrazine compounds are the compounds described in Looker and Kerr, U.S. Pat. No. 4,994,365, issued Feb. 19, 1991. These compounds are aryl sulfonamidophenyl hydrazides containing an alkyl pyridinium group which have the formula:

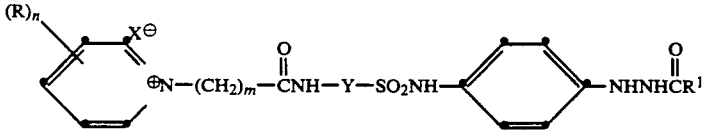

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by $R^1$ can be, for example

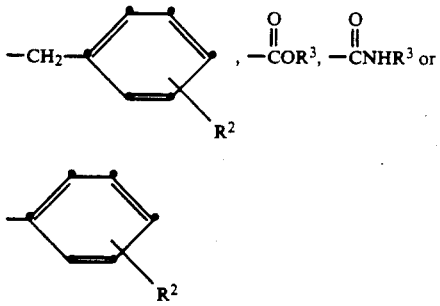

where $R^2$ is hydroxy or a hydroxy-substituted alkyl group having from 1 to 4 carbon atoms and $R^3$ is an alkyl group having from 1 to 4 carbon atoms.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,422, 4,740,452, 4,912,016, 4,914,003, 4,975,354, 4,988,604, 4,994,365, and 5,041,355.

The hydrazine compound utilized as a nucleator in this invention is usually employed in an amount of from about 0.005 millimoles to about 100 millimoles per mole of silver and more typically from about 0.1 millimoles to about 10 millimoles per mole of silver.

The hydrazine compounds are employed in this invention in combination with negative-working photographic emulsions comprised of radiation-sensitive silver halide grains capable of forming a surface latent image and a binder. Useful silver halides include silver chloride, silver chlorobromide, silver chlorobromoiodide, silver bromide and silver bromoiodide.

Silver halide grains suitable for use in the emulsions of this invention are capable of forming a surface latent image, as opposed to being of the internal latent image-forming type. Surface latent image silver halide grains are employed in the majority of negative-working silver halide emulsions, whereas internal latent image-forming silver halide grains, while capable of forming a negative image when developed in an internal developer, are usually employed with surface developers to form direct-positive images. The distinction between surface latent image and internal latent image silver halide grains is generally well recognized in the art.

The silver halide grains, when the emulsions are used for lith applications, have a mean grain size of not larger than about 0.7 micron, preferably about 0.4 micron or less. Mean grain size is well understood by those skilled in the art, and is illustrated by Mees and James, *The Theory of the Photographic Process*, 3rd Ed., MacMillan 1966, Chapter 1, pp. 36–43. The photographic emulsions can be coated to provide emulsion layers in the photographic elements of any conventional silver coverage. Conventional silver coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the mean grain size.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more, it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin) gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids, the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, aleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialylaminoalkyl acrylates, vinyl imidazole copolymers, vinyl sulfide copolymers, halogenated styrene polymers, amineacrylamide polymers, polypeptides and the like.

Although the term "binder" is employed in describing the continuous phase of the silver halide emulsions, it is recognized that other term commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, December 1971, Item 9232, which disclosure is hereby incorporated by reference.

Emulsions according to this invention having silver halide grains of any conventional geometric form (e.g. regular cubic or octahedral crystalline form) can be prepared by a variety of techniques, e.g., single-jet, double-jet (including continuous removal techniques), accelerated flow rate and interrupted precipitation techniques, as illustrated by Trivelli and Smith, *The Photographic Journal, Vol. LXXIX, May* 1939, pp. 330–338, T. H. James, *The Theory of the Photographic Process,* 4th Ed., MacMillan, 1977, Chapter 3; Terwilliger et al Research Disclosure, Vol 149, September 1976, Item 14987, as well as U.S. Pat. Nos. 2,222,264; 3,650,757; 3,672,900; 3,917,485; 3,790,387; 3,761,276 and 3,979,213, and German OLS No. 2,107,118 and U. K. Patent Publications 335,925, 1,430,465 and 1,469,480, which publications are incorporated herein by reference.

It is particularly preferred that the silver halide grains are doped to provide high contrast As is known in the art, use of a suitable doping agent, in concert with the use of a hydrazine compound that functions as a nucleator, is capable of providing an extremely high contrast response Doping agents are typically added during the crystal growth stages of emulsion preparation, for example, during initial precipitation and/or physical ripening of the silver halide grains. Rhodium is a particularly effective doping agent, and can be incorporated in the grains by use of suitable salts such as rhodium trichloride. Rhodium-doping of the silver halide grains employed in this invention is especially beneficial in facilitating the use of chemical sensitizing agents without encountering undesirably high levels of pepper fog. Doping agents described in McDugle et al, U.S. Pat. No. 4,933,272 as being useful in graphic arts emulsions, can also be advantageously employed. These are hexacoordinated complexes of the formula:

$$[M'(NO)(L')_b]^m$$

wherein m is zero, −1, −2, or −3.

M' represents chromium, rhenium, ruthenium, osmium or iridium, and L' represents one or a combination of halide and cyanide ligands or a combination of these ligands with up to two aquo ligands.

The silver halide emulsions can be chemically sensitized with active gelatin, as illustrated by T. H. James, *The Theory of the Photographic Process,* 4th Ed., MacMillan, 1977, pp. 67–76, or with sulfur, selenium, tellurium, platinum, gold, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 134, June 1975, Item 13452. The emulsions need not be chemically sensitized, however, in order to exhibit the advantages of this invention.

The silver halide emulsions can be spectrally sensitized with dyes from a variety of classes, including the polymethine dye class, which includes the cyanines, merocyanines, complex cyanines and merocyanines, (i.e., tri-, tetra- and polynuclear cyanines and merocyanines), oxonols, hemioxonols, styryls, merostyryls and streptocyanines.

A particularly preferred method of achieving chemical sensitization is by use of a combination of a gold compound and a urea compound as described in copending commonly assigned U.S. patent application Ser. No. 735,979, filed Jul. 25, 1991, entitled "Nucleated High Contrast Photographic Elements Containing Urea Compounds Which Enhance Speed And Increase Contrast", by Anthony Adin. This method provides exceptional results when used with high-chloride silver halide emulsions, i.e., those in which at least the surface portion of the silver halide grains is composed of more than 50 mole percent silver chloride. The combination of the gold compound and urea compound functions to enhance speed and increase contrast in the toe region of the sensitometric curve, without a concurrent increase in fog. Urea compounds effective for this purpose are 1,1,3,3-tetra-substituted middle chalcogen urea compounds in which at least one substituent comprises a nucleophilic center. A combination of potassium tetrachloroaurate and 1,3-dicarboxymethyl-1,3-dimethyl-2-thiourea is especially effective.

Chemical sensitization can also be provided by use of a combination of a gold compound and a thiourea compound as described in copending commonly assigned U.S. patent application Ser. No. 825,349, filed Jan. 24, 1992, "Nucleated High Contrast Photographic Elements Containing Substituted Thioureas Which Enhance Speed And Increase Contrast", by Anthony Adin.

The photographic system to which this invention pertains is one which employs a hydrazine compound as a nucleating agent and an amino compound as an incorporated booster. Amino compounds which are particularly effective as incorporated boosters are described in Machonkin and Kerr, U.S. Pat. No. 4,975,354, issued Dec. 4, 1990.

The amino compounds useful as incorporated boosters described in U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient (as hereinafter defined) of at least one, preferably at least three, and most preferably at least four.

Included within the scope of the amino compounds utilized in this invention as incorporated boosters are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as incorporated boosters are compounds of at least 20 carbon atom.

Preferred amino compounds for use as incorporated boosters are bis-tertiary-amines which have a partition coefficient of at least three and a structure represented by the formula:

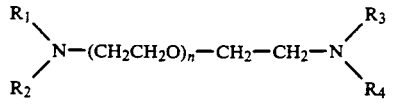

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atom necessary to complete a heterocyclic ring.

Another advantageous group of ano compounds for use as incorporated boosters are bis-secondary amines which have a partition coefficient of at least three and a structure represented by the formula:

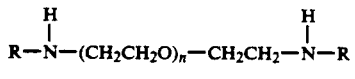

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The most preferred amino compound for use in this invention as an incorporated booster is a compound of the formula:

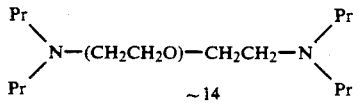

where Pr represents n-propyl.

Other amino compounds useful as incorporated boosters are described in Yagihara et al, U.S. Pat. No. 4,914,003 issued Apr. 3, 1990. The amino compounds described in this patent are represented by the formula:

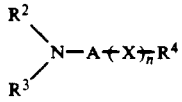

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents $—CONR^5—$, $—O—CONR^5$, $—NR^5CONR^5$, $—NR^5COO—$, —COO—, —OCO—, —CO—, $—NR^5CO—$, $—SO_2NR^5—$, $—NR^5SO_2—$, $—SO_2—$, —S— or —O— group in which $R^5$ represents a hydrogen atom or a lower alkyl group and n represents 0 or 1, with the proviso that the total number of carbon atoms contained in $R^2$, $R^3$, $R^4$ and A is 20 or more.

Still other amino compounds useful as incorporated boosters are described in Katoh et al, U.S. Pat. No. 5,030,547, issued Jul. 9, 1991. The amino compounds described in this patent are represented by the formula:

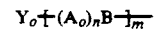

wherein $Y_o$ represents a group which promotes adsorption to silver halide, $A_o$ represents a divalent linking group, B represents an amino group, an ammonium group or a nitrogen-containing heterocyclic group, m is 1, 2 or 3 and n is 1 or 2.

The amino compound utilized as an incorporated booster is typically employed in an amount of from about 0.1 to about 25 millimoles per mole of silver, and more preferably in an amount of from about 0.5 to about 15 millimoles per mole of silver.

Particularly preferred sensitizing dyes for use in this invention are the benzimidazolocarbocyanine dyes described in copending commonly assigned U.S. patent application Ser. No. 735,484, filed Jul. 25, 1991, "Nucleated High Contrast Photographic Elements Containing Low-Stain Sensitizing Dyes", by Anthony Adin, Linda J. Knapp, and Steven G. Link. These dyes provide enhanced photographic sensitivity, yet leave substantially no sensitizing dye stain after rapid access processing.

The benzimidazolocarbocyanine sensitizing dyes described in the aforesaid patent application are benzimidazolocarbocyanine sensitizing dyes having at least one acid-substituted alkyl group attached to a nitrogen atom of a benzimidazole ring. Preferred examples of such dyes are those of the formula:

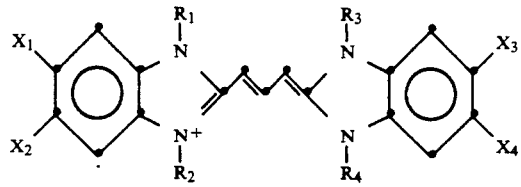

wherein $X_1$, $X_2$, $X_3$ and $X_4$ are, independently, hydrogen, cyano, alkyl, halo, haloalkyl, alkylthio, alkoxycarbonyl, aryl, carbamoyl or substituted carbamoyl, $R_1$ and $R_3$ are alkyl, and $R_2$ and $R_4$ are, independently, alkyl, alkenyl, substituted alkyl or substituted alkenyl with the proviso that at least one of $R_2$ and $R_4$ is acid-substituted alkyl and with the further proviso that when both $R_2$ and $R_4$ are acid-substituted alkyl, there is also a cation present to balance the charge.

As hereinabove described, the present invention provides a process for forming a high-contrast photographic image comprising the steps of:

(1) imagewise exposing a silver halide photographic element and (2) developing the exposed element with an aqueous alkaline developing solution; wherein said photographic element contains a hydrazine compound which functions as a nucleating agent and an amino compound which functions as an incorporated booster and wherein said developing solution is free of dihydroxybenzene developing agents, has a pH in the range of from 9.5 to 11.5 and comprises (1) an ascorbic acid developing agent, (2) an auxiliary super-additive developing agent and (3) a carbonate buffering agent in a concentration of at least 0.5 molar.

By the term "an ascorbic acid developing agent", as used herein, it is intended to include ascorbic acid and the analogues, isomers and derivatives thereof which function as photographic developing agents. Ascorbic acid developing agents are very well known in the photographic art (see the references cited hereinabove) and include, for example, the following compounds:

L-ascorbic acid
D-ascorbic acid
L-erythroascorbic acid
D-glucoascorbic acid
6-desoxy-L-ascorbic acid
L-rhamnoascorbic acid
D-glucoheptoascorbic acid
imino-L-erythroascorbic acid
imino-D-glucoascorbic acid
imino-6-desoxy-L-ascorbic acid
imino-D-glucoheptoascorbic acid
sodium isoascorbate
L-glycoascorbic acid
D-galactoascorbic acid
L-araboascorbic acid
sorboascorbic acid
sodium ascorbate
and the like The auxiliary super-additive developing agents employed in the aqueous alkaline developing solutions of this invention are also well known and widely used in photographic processing. As explained in Mason, "Photographic Processing Chemistry", Focal Press, London, 1975, "super-additivity" refers to a synergistic effect whereby the combined activity of a mixture of two developing agents is greater than the sum of the two activities when each agent is used alone in the same developing solution (Note especially the paragraph entitled, "Superadditivity" on Page 29 of Mason).

For the purposes of this invention, the preferred auxiliary super-additive developing agents are the 3-pyrazolidone developing agents. Particularly preferred developing agents of this class are those represented by the formula:

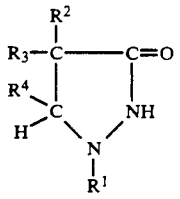

in which $R^1$ is aryl (including substituted aryl) and $R^2$, $R^3$, and $R^4$ are hydrogen or alkyl (including substituted alkyl). Included within the definition of $R^1$ are phenyl and phenyl substituted with groups such as methyl, chloro, amino, methylamino, acetylamino, nethoxy and methylsulfonamidoethyl. Included within the definition of $R^2$, $R^3$ and $R^4$ are unsubstituted alkyl and alkyl substituted with groups such as hydroxy, carboxy, or sulfo. The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include:

1-phenyl-5-methyl-3-pyrazolidone,
1-phenyl-4,4-diethyl-3-pyrazolidone,
1-p-aminophenyl-4-methyl-4-propyl-3-pyrazolidone,
1-p-chlorophenyl-4-methyl-4-ethyl-3-pyrazolidone,
1-p-acetamidophenyl-4,4-diethyl-3-pyrazolidone,
1-p-betahydroxyethylphenyl-4,4-dimethyl-3-pyrazolidone,
1-p-hydroxyphenyl-4,4-dimethyl-3-pyrazolidone,
1-p-methoxyphenyl-4,4-diethyl-3-pyrazolidone,
1-p-tolyl-4,4-dimethyl-3-pyrazolidone, and the like.

Less preferred but also useful auxiliary super-additive developing agents for use in the aqueous alkaline developing solutions of this invention are aminophenols. Examples of useful aminophenols include:

p-aminophenol
o-aminophenol
N-methylaminophenol
2,4-diaminophenol hydrochloride
N-(4-hydroxyphenyl)glycine
p-benzylaminophenol hydrochloride
2,4-diamino-6-methylphenol
2,4-diaminoresorcinol
N-(beta-hydroxyethyl)-p-aminophenol, and the like.

More than one auxiliary super-additive developing agent can be incorporated in the developing solutions of this invention, if desired. For example, the developing solution can contain ascorbic acid, 1-phenyl-3-pyrazolidone, and N-methylaminophenol. More than one ascorbic acid developing agent can, of course, also be utilized, if desired.

By the term "sulfite preservative" as used herein is meant any sulfur compound that is capable of forming sulfite ions in aqueous alkaline solution. Examples of such compounds include alkali metal sulfites, alkali metal bisulfites, alkali metal metabisulfites, sulfurous acid and carbonyl-bisulfite adducts.

Examples of preferred sulfites for use in the developing solutions of this invention include sodium sulfite ($Na_2SO_3$), potassium sulfite ($K_2SO_3$), lithium sulfite ($Li_2SO_3$), sodium bisulfite ($NaHSO_3$), potassium bisulfite ($KHSO_3$), lithium bisulfite ($LiHSO_3$), sodium metabisulfite ($Na_2S_2O_5$), potassium metabisulfite ($K_2S_2O_5$), and lithium metabisulfite ($Li_2S_2O_5$).

The carbonyl-bisulfite adducts which are useful in this invention are well-known compounds. Adducts of adehydes and adducts of ketones are useful and the adlehydes employed can be monoaldehydes, dialdehydes or trialdehydes and the ketones can be monoketones, diketones or triketones. The bisulfite adducts can be adducts of alkali metal bisulfites, alkaline earth metal bisulfites or nitrogen-base bisulfites such as amine bisulfites.

Illustrative examples of the many carbonyl-bisulfite adducts which are useful in the present invention include the following compounds (all of those listed being sodium bisulfite adducts for the purpose of convenience in illustrating the invention but it being understood that the compounds can also be employed in the form of adducts of other suitable bisulfites as explained hereinabove):

sodium formaldehyde bisulfite
sodium acetaldehyde bisulfite
sodium propionaldehyde bisulfite
sodium butyraldehyde bisulfite
succinaldehyde bis-sodium bisulfite
glutaraldehyde bis-sodium bisulfite
beta-methyl glutaraldehyde bis-sodium bisulfite
maleic dialdehyde bis-sodium bisulfite
sodium acetone bisulfite sodium butanone bisulfite
sodium pentanone bisulfite
2,4-pentandione bis-sodium bisulfite, and the like.

The carbonate buffering agents utilized in the developing solutions of this invention are agents which are very commonly used in photographic developing solutions. Examples of particularly useful compounds include sodium carbonate ($Na_2CO_3$) and potassium carbonate ($K_2CO_3$). Mixtures of sodium carbonate and potassium carbonate can be used, if desired.

The amount of ascorbic acid developing agent utilized in the developing solutions of this invention can vary widely as desired. Typically, amounts of from about 0.05 to about 0.5 moles per liter are useful. Preferably, amounts in the range of from 0.1 to 0.3 moles per liter are employed.

The amount of auxiliary super-additive developing agent utilized in the developing solutions of this invention can vary widely as desired. Typically, amounts of from about 0.001 to about 0.01 moles per liter are useful. Preferably, amounts in the range of from 0.002 to 0.008 moles per liter are employed.

The amount of carbonate buffering agent required in the developing solutions of this invention is an amount of at least 0.5 moles per liter, and preferably at least 0.8 moles per liter with amounts in the range of from 0.9 to 1.5 moles per liter being particularly preferred.

The amount of sulfite preservative incorporated in the developing solutions of this invention can range from zero to 0.5 moles per liter, with amounts in the range of from 0.1 to 0.2 moles per liter being preferred.

The developing solutions of this invention have a pH in the range of from 9.5 to 11.5 and preferably in the range of from 10 to 11. In this regard, they are distinctly different from the low pH ascorbic acid developing solutions of U.S. Pat. No. 3,022,168 which have a pH in the range of from 8 to 9. Developing solutions with a pH in the range of from 8 to 9 are not effective in developing high contrast graphic arts films of the type described in U.S. Pat. No. 4,975,354.

The developing solutions of this invention are free of dihydroxybenzene developing agents such as hydroquinone. Thus, they are advantageous from an ecological and environmental standpoint in comparison with the hydroquinone developers that are currently in widespread commercial use.

The developing solutions of this invention are also advantageous in minimizing problems of silver mirroring that can occur in photographic processing, i.e., the plating out of silver on processing equipment.

The developing solutions of this invention are useful for forming black-and-white silver images by development of light-sensitive silver halide photographic elements of any different types, including, for example, microfilms, aerial films and X-ray films. They are especially useful in the field of graphic arts for forming very high contrast silver images. In the graphic arts field, they can be used with a wide variety of graphic arts films in addition to those specifically described in U.S. Pat. No. 4,975,354.

While the essential ingredients of the novel developing solution of this invention are an ascorbic acid developing agent, an auxiliary super-additive developing agent, and a carbonate buffering agent, a variety of other optional ingredients can also be advantageously included in the developing solution. For example, the developing solution can contain one or more antifoggants, antioxidants, sequestering agents, stabilizing agents or contrast-promoting agents.

Examples of particularly useful contrast-promoting agents are amino compounds as described, for example. in U.S. Pat. No. 4,269,929.

Examples of useful stabilizing agents are α-ketocarboxylic acids as described, for example, in U.S. Pat. No. 4,756,997.

In carrying out the method of this invention, it is preferred to employ one or more organic antifoggants to minimize fog formation. The organic antifoggants can be incorporated in the photographic element or they can be added to the developing solution, the essential requirement being that they be present during the developing process. Particularly advantageous results are achieved with the use of benzotriazole antifoggants. A further preferred class or organic antifoggants are the mercapto azole antifoggants. Inorganic antifoggants or restrainers, such as alkali metal bromides, can be utilized in conjunction with the use of an organic antifoggant if desired.

Particularly preferred benzotriazole antifoggants for use in the developing solutions of this invention are benzotriazole, halo-substituted benzotriazoles such as 4-chlorobenzotriazole; 4-romobenzotriazole and 5-chlorobenzotriazole, and alkyl-substituted benzotriazoles such as 5-methylbenzotriazole.

Preferred mercapto azole antifoggants are those represented by the formula:

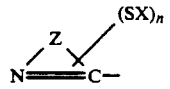

wherein represents the atoms necessary to complete a 5 to 6 ember heterocyclic ring, such as pyrimidine, triazine, tetrazole, triazole, imidazole, diazole, oxadiazole or thiadiazole ring; and SX represents a mercapto function, n being a whole number, typically a number from 1 to about 3, any free bonds being satisfied by hydrogen atoms. In the mercapto function or group, X is a cation which includes hydrogen, an alkali metal, e.g., sodium or potassium, ammonium or an organic amine residue of such amines as triethyl amine, triethanol amine, morpholine and the like.

Mercapto tetrazole antifoggants are especially suitable in the practice of this invention and include those of the formula:

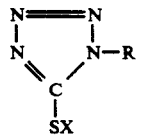

wherein R is an aliphatic or aromatic radical containing up to about 30 carbon atoms and SX is a mercapto function.

Specific examples of mercapto azole antifoggants include:

mercapto-substituted pyrimidines such as: thiobarbituric acid and thiouracil, mercapto-substituted oxadiazoles or thiadiazoles such as 5-phenyl-2-mercapto-1,3,4-oxadiazole and 5-o-tolyl-2-mercapto-1,3,4-thiadiazole, mercapto triazines such as: 2,4,6-trimercapto-1,3,5-triazine, mercapto imidazoles such as:

2-mercapto-5-phenylimidazole, condensed imidazoles such as: 2-mercaptobenzimidazole, triazoles such as: 3,4-diphenyl-5-mercapto-1,2,4-triazole and 3-mercapto-5-methyl-1,2,4-triazole, mercapto tetrazoles such as: 1-phenyl-5-mercaptotetrazole and 1-(3-capramido)phenyl-5-mercaptotetrazole.

In processing photographic elements with the developing solutions described herein, the time and temperature employed for development can be varied widely. Typically, the development temperature will be in the range of from about 20° C. (68° F.) to about 50° C. (122° F.), more preferably in the range of from about 25° C. (77° F.) to about 40° C. (104° F.), while the development time will be in the range of from about 10 seconds to about 150 seconds, more preferably in the range of from about 20 seconds to about 120 seconds.

It should be noted that, while the novel developing solution of this invention is broadly useful in a wide variety of photographic processes, it is especially adapted for use in the process of developing high contrast nucleated photographic elements of the type described herein. For use in this process a critical feature of the developing solution is a high ionic strength as represented by a carbonate buffering agent concentration of at least 0.5 molar. Use of potassium carbonate at a level of 24 grams per liter (0.17 molar) as in the working examples of Australian Patent Application No. 70070/91 and Canadian Patent Application No. 2,035,049, would be highly disadvantageous in the process of this invention since the developing solution would lack adequate stability to withstand the effects of seasoning and would tend to undergo an undesirable decrease in pH on seasoning from the combined effects of aerial oxidation and silver halide development. Stability to pH change on seasoning is especially important in the high contrast process for nucleated photographic elements described herein.

For optimum performance with hydrazide-nucleated high-contrast photographic elements, the developing solution of this invention should contain a 3-pyrazolidone as the auxiliary super-additive developing agent; the 3-pyrazolidone should be used at a relatively high level in comparison with its use in hydroquinone developers, i.e. at a level of 0.002 to 0.008 moles per liter; the developing solution should contain a sulfite preservative; and the sulfite preservative should be used at a relatively low level in comparison with its use in hydroquinone developers, i.e., at a level of 0.1 to 0.2 moles per liter.

The invention is further illustrated by the following examples of its practice. In these examples, reference is made to emulsion addenda having structures as indicated below:

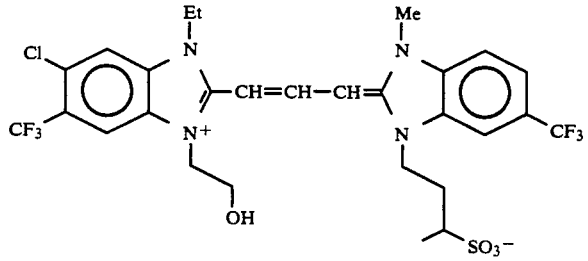

A-1

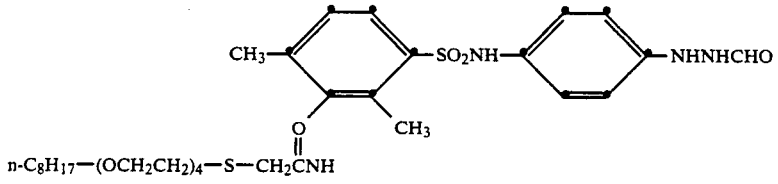

A-2

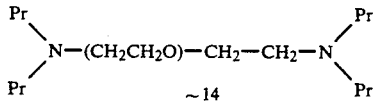

A-3

The examples which follow refer to Film A and Film B. Film A is a non-nucleated, moderately high contrast, graphic arts film that is especially adapted for electronic scanner exposures and is available commercially from EASTMAN KODAK COMPANY as KODAK ESY Scanner Film. Film B is an ultra-high-contrast nucleated film, especially adapted for camera halftone and line exposures, of the type described in U.S. Pat. No. 4,975,354. To prepare Film B, a monodispersed 0.23 micrometer, cubic, rhodium-doped, sulfur plus gold sensitized AgClBr (70/30) emulsion was coated on a polyester support at 2.79 g/m$^2$ Ag, 2.32 g/m$^2$ gelatin and 0.86 g/m$^2$ latex, where the latex is a copolymer of ethyl acrylate, 2-acrylamido-2-methylpropane sulfonic acid and 2-acetoacetoxyethyl methacrylate. The emulsion was spectrally sensitized with 250 mg/Ag mol of sensitizing dye A-1. The hydrazide nucleator A-2 as added to the emulsion as a methanol solution at 0.15 mmol/Agmol. The booster A-3, also added as a ethanol solution, was incorporated in the emulsion at 2 g/Agmol A protective layer comprised of 1.19 g/m$^2$ gelatin and 0.032 g/m$^2$ matte beads was coated over the emulsion layer.

EXAMPLE 1

A developing solution within the scope of the present invention, referred to hereinafter as Solution (1), was prepared in accordance with the following formulation:

| Component | Concentration |
|---|---|
| Sodium sulfite | 0.125 molar |
| L-ascorbic acid | 0.20 molar |
| MOP* | 2.0 g/liter |
| Potassium carbonate | 0.90 molar |
| Benzotriazole | 0.20 g/liter |
| Sodium bromide | 6.0 g/liter |

*MOP is 1-phenyl-4-hydroxymethyl-4-methyl-3-pyrazolidone

A conventional rapid-access hydroquinone developing solution, referred to hereinafter as Solution (2), was prepared in accordance with the following formulation:

| Component | Concentration |
|---|---|
| Sodium sulfite | 0.38 molar |
| Hydroquinone | 0.15 molar |
| MOP | 0.73 g/liter |
| Potassium carbonate | 0.10 molar |
| Benzotriazole | 0.10 g/liter |
| 1-Phenyl-5-mercapto-tetrazole | 12.5 mg/liter |
| Sodium bromide | 3 g/liter |

The pH of Solution (1) was 10.3 while the pH of Solution (2) was 10.5.

Samples of both Film A and Film B were processed in each of Solutions (1) and (2), using a MOHRPRO Model 8 tabletop processor and a 35° C., 37-second development cycle, and standard sensitometry exposures were processed and analyzed to monitor speed and shoulder density effects.

With Film B, an electronic image analyzer was used to scan processed unexposed samples and count the number of pepper fog spots (> 10 micrometer diameter) contained in an area of 600 square millimeters. Image spread measurements were performed by following the growth in diameter of halftone dots with development time. The film were contact exposed to a 52 line/cm 90% tint to produce a 10% exposed dot pattern. The films were then developed in a device that measures the infrared (IR) density during development. The integrated IR halftone density of the developing tint pattern was converted to the equivalent dot diameter using the relation between integrated density and percent dot area. The resulting plots of increasing dot diameter with development time were linear (constant dot growth rate) during the first 60 to 90 seconds of development. The slope of the linear dot diameter versus development response is equal to the dot growth rate.

Results for both Films A and B in Solutions (1) and (2) are summarized in Table I below.

TABLE I

| Film | Developing Solution | Relative Sensitivity* | PDP** | PF*** | Dot Growth Rate (microns/sec) |
|---|---|---|---|---|---|
| A | (1) | 18 | 3.38 | — | — |
| A | (2) | 18 | 3.54 | — | — |
| B | (1) | 110 | 5.31 | 2 | 0.28 |
| B | (2) | 100 | 4.83 | 18 | 0.43 |

*Relative Sensitivity is inversely proportional to exposure at $D_{net} = 0.6$.
**PDP is the Practical Density Point, the density at 0.4 Log E exposure beyond the 0.6 net density speed point. PDP is a composite measure of shoulder density and upper scale contrast.
*** PF is the number of pepper fog spots detected by the pepper fog analyzer.

As indicated by the data in Table I, with Film A, which is a non-nucleated film, the same speed and similar PDP values are obtained with Solutions (1) and (2). With Film B, which is a nucleated film, faster speed and higher PDP, which are both desirable features, are achieved with Solution (1). Furthermore, Solution (1) gave lower values of the two undesirable features of nucleated development, namely, pepper fog and chemical spread. This is a very unexpected result since modifications to a nucleated system, either to the film or to the developer, to increase speed and PDP have typically been accompanied by undesirable increases in pepper fog and chemical spread. Examples of such system modifications include raising the developer pH or increasing the amount of nucleator in the film.

EXAMPLE 2

In order to evaluate sensitivity to pH changes in the developing solution, speed and PDP measurements were made with Film B processed in samples of Solutions (1) and (2) which had been adjusted in pH. The results obtained are summarized in Table II below.

TABLE II

| | pH | Relative Sensitivity | PDP |
|---|---|---|---|
| Solution (1) | 10.0 | 94 | 4.96 |
| | 10.3 | 110 | 5.21 |
| | 10.6 | 123 | 5.27 |
| Solution (2) | 10.3 | 85 | 4.39 |
| | 10.5 | 100 | 5.02 |
| | 10.7 | 126 | 5.35 |

As shown by the data in Table II, use of Solution (1), which is an ascorbic acid developing solution formulated in accordance with the present invention, provides a relatively small degree of pH sensitivity in processing a nucleated film. The ascorbic acid developing solution clearly provides higher speed and shoulder density at the lower end of the practical pH range of carbonate buffering. This favorable characteristic of the ascorbic acid developing solution helps to compensate for the inherent pH drop that occurs in the developing solution upon seasoning.

EXAMPLE 3

In order to evaluate sensitivity to changes in the bromide content of the developing solution, speed and PDP measurements were made with Film A processed in samples of Solution (1) in which bromide content had been adjusted by addition of sodium bromide. Also, speed, PDP, pepper fog and chemical spread measurements were made with Film B processed in samples of both Solution (1) and Solution (2) in which bromide content had been similarly adjusted. The results obtained are summarized in Table III below.

TABLE III

| Film | Developing Solution | NaBr Added (g/liter) | Relative Sensitivity | PDP | PF | Dot Growth Rate (microns/sec) |
|---|---|---|---|---|---|---|
| A | (1) | 0 | 18 | 3.39 | — | — |
| | | 3 | 19 | 3.38 | — | — |
| | | 6 | 19 | 3.41 | — | — |
| B | (1) | 0 | 110 | 5.22 | 2 | 0.30 |
| | | 3 | 110 | 5.23 | 0 | 0.34 |
| | | 6 | 110 | 5.16 | 2 | 0.35 |
| B | (2) | 0 | 100 | 4.91 | 2 | 0.40 |
| | | 3 | 100 | 4.19 | 2 | 0.40 |
| | | 6 | 95 | 3.17 | 0 | 0.33 |

As shown by the data in Table III, the ascorbic acid developing solution of this invention (Solution (1)) exhibited almost no sensitivity to changes in bromide level with either the non-nucleated film (Film A) or the nucleated film (Film B). Thus, the ascorbic acid developing solution of this invention is able to handle a variety of halide ratio film (intermix) without serious impact upon film response.

EXAMPLE 4

A series of developing solutions was prepared in order to evaluate the effect of varying the levels of ascorbic acid developing agent, auxiliary developing agent, carbonate buffering agent and sulfite preservative on the performance of the developing solution with both nucleated and non-nucleated films. These developing solution formulations were as follows, with all other components and developer parameters, such as pH, bromide content and benzotriazole content being the same as in Example 1.

| Developing Solution | Ascorbic Acid Molarity | MOP (g/l) | Potassium Carbonate Molarity | Sodium Sulfite Molarity |
|---|---|---|---|---|
| A | 0.05 | 2 | 0.9 | 0.125 |
| B | 0.10 | 2 | 0.9 | 0.125 |
| C | 0.20 | 2 | 0.9 | 0.125 |
| D | 0.30 | 2 | 0.9 | 0.125 |
| E | 0.20 | 1 | 0.9 | 0.125 |
| F | 0.20 | 0.5 | 0.9 | 0.125 |
| G | 0.20 | 2 | 0.54 | 0.125 |
| H | 0.20 | 2 | 1.26 | 0.125 |
| I | 0.20 | 2 | 0.9 | 0 |
| J | 0.20 | 2 | 0.9 | 0.375 |
| K | 0.20 | 2 | 0.54 | 0.375 |
| L | 0.20 | 2 | 1.26 | 0 |

The results obtained with developing solutions A, B, C and D, which form an ascorbic acid level series, are reported in Table IV below.

TABLE IV

| Film | Developing Solution | Relative Sensitivity | PDP | PF | Dot Growth Rate (microns/sec) |
|---|---|---|---|---|---|
| A | A | 17 | 3.07 | — | — |
| A | B | 18 | 3.33 | — | — |
| A | C | 18 | 3.37 | — | — |
| A | D | 17 | 3.22 | — | — |
| B | A | 115 | 2.74 | 71 | 0.46 |
| B | B | 120 | 4.64 | 107 | 0.47 |
| B | C | 110 | 5.22 | 2 | 0.30 |
| B | D | 98 | 5.06 | 2 | 0.16 |

As shown by the data in Table IV, development of the non-nucleated film (Film A) is not sensitive to change in the ascorbic acid level. In developing the nucleated film (Film B), use of a low level of ascorbic acid, as in developing solution A, gives an undesirably low value for PDP. Use of a high level of ascorbic acid, as in developing solution D, has an adverse effect on speed. Overall, the data reported in Table IV indicate that the level of ascorbic acid developing agent is not narrowly critical and can be varied over a wide range as desired.

The results obtained with developing solutions C, E and F, which form a MOP level series, are reported in Table V below.

TABLE V

| Film | Developing Solution | Relative Sensitivity | PDP | PF | Dot Growth Rate (microns/sec) |
|---|---|---|---|---|---|
| A | F | 17 | 3.46 | — | — |
| A | E | 18 | 3.45 | — | — |
| A | C | 18 | 3.37 | — | — |
| B | F | 103 | 5.17 | 5 | 0.26 |
| B | E | 107 | 5.36 | 5 | 0.29 |
| B | C | 110 | 5.22 | 2 | 0.30 |

As indicated by the data in Table V, the level of auxiliary developing agent is not narrowly critical and can be varied over a wide range, as desired, with both the non-nucleated film (Film A) and the nucleated film (Film B).

The results obtained with developing solutions C, G, H, I, J, K and L, which form a matrix of carbonate and sulfite concentrations, are reported in Table VI below.

TABLE VI

| Film | Developing Solution | Relative Sensitivity | PDP | PF | Dot Growth Rate (microns/sec) |
|---|---|---|---|---|---|
| A | C | 15 | 3.37 | — | — |
| A | G | 15 | 3.54 | — | — |
| A | H | 15 | 3.30 | — | — |
| A | J | 15 | 3.28 | — | — |
| A | K | 15 | 3.41 | — | — |
| A | L | 14 | 3.33 | — | — |
| B | C | 100 | 5.22 | 2 | 0.28 |
| B | G | 102 | 5.12 | 2 | 0.25 |
| B | H | 91 | 5.08 | 1 | 0.20 |
| B | I | 100 | 5.22 | 2 | 0.31 |
| B | J | 95 | 5.00 | 1 | 0 20 |
| B | K | 98 | 4.88 | 1 | 0.29 |
| B | L | 89 | 5.21 | 1 | 0.30 |

As indicated by the data in Table VI, changes in photographic response over the matrix for the non-nucleated film (Film A) were practically nil and changes in photographic response, pepper fog and chemical spread for the nucleated film (Film B) were quite minor. A slight falloff in upper scale activity (PDP) is seen in the nucleated film at the highest level of sulfite concentration tested. As shown by the data for developing solutions I and L, sulfite can be omitted entirely and satisfactory results can still be obtained. Overall, the carbonate/sulfite balance of the ascorbic acid developing solution of this invention is remarkably flexible and appropriate adjustments can be freely make to meed aeration protection and buffering requirements as described hereinbefore.

EXAMPLE 5

Developing solutions, referred to herein as solutions M and N, were prepared in order to evaluate the effects of variation in auxiliary developing agent. Solution M was the same as Solution (1) except that the 2.0 g/liter of MOP was replaced with 1.3 g/liter of N-methylaminophenol. Solution N was the same as Solution (1) except that the 2.0 g/liter of MOP was replaced with 1.9 g/liter of 1-phenyl-4,4-dimethyl-1,3-pyrazolidone. These developing solutions were evaluated with both the nucleated and non-nucleated film and the results obtained are reported in Table VII below.

TABLE VII

| Film | Developing Solution | Relative Sensitivity | PDP | PF | Dot Growth Rate (microns/sec) |
|---|---|---|---|---|---|
| A | (1) | 18 | 3.39 | — | — |
| A | M | 16 | 3.36 | — | — |
| A | N | 17 | 3.42 | — | — |
| B | (1) | 110 | 5.22 | 3 | 0.30 |
| B | M | 83 | 4.60 | 9 | 0.25 |
| B | N | 112 | 5.34 | 6 | 0.32 |

As shown by the data in Table VII all three developing solutions gave similar results with the non-nucleated film (Film A). With the nucleated film (Film B), the developing solution containing N-methylaminophenol as the auxiliary developing agent gave significantly lower nucleation activity in terms of lower speed and PDP. Thus, the pyrazolidone compounds are preferred as auxiliary developing agents in the developing solutions of this invention.

In summary, the developing solutions of this invention, which comprise an ascorbic acid developing agent, an auxiliary super-additive developing agent and a carbonate buffering agent at a concentration of at least 0.5 molar, provide an environmentally favorable alternative to the use of conventional developing solutions which contain a dihydroxybenzene developing agent such as hydroquinone. When used with non-nucleated graphic arts film, they provide a level of performance which is at least equal to that of conventional developing solutions containing hydroquinone. When employed with nucleated high contrast graphic arts films—containing a hydrazine compound that functions as a nucleating agent and an amino compound that functions as an incorporated booster—they provide several unexpected advantages. These advantages include increased speed and upper scale development together with lower pepper fog and reduced chemical spread. They also include less sensitivity to variations in process pH and bromide concentration. The novel developing solutions of this invention are characterized by a high level of carbonate for high pH buffering and aeration protection via reduced oxygen solubility. Sulfite can be utilized at a low level, as compared to a typical hydroquinone developer, or even eliminated since there are fewer roles for sulfite to perform in an ascorbic acid developing solution than in a hydroquinone developing solution. While ascorbic acid and derivatives thereof have long been known to be useful as developing agents in the processing of silver halide photographic elements, it was neither known nor expected that they could be used with nucleated films to give results significantly superior to those achieved with conventional hydroquinone developers.

The developing solution of this invention has particular unexpected benefits when used with nucleated high-contrast graphic arts photographic elements, as described hereinabove. It is also very useful, however, with non-nucleated photographic elements in that it is at least as good as typical commercially-available hydroquinone developers in terms of capacity and in terms of sensitometric stability with extended aerial contact, yet is markedly better from an ecological and environmental standpoint.

The invention has been described in detail with particular reference to preferred embodiments thereof, but it will be understood that variations and modifications can be effected within the spirit and scope of the invention.

We claim:

1. An aqueous alkaline photographic developing solution that is free of dihydroxybenzene developing agents, said developing solution having a pH in the range of from 9.5 to 11.5 and comprising: .

(1) an ascorbic acid developing agent, (2) an auxiliary super-additive developing agent, and (3) a carbonate buffering agent in a concentration of at least 0.5 molar.

2. A developing solution as claimed in claim 1, wherein the pH is in the range of from 10 to 11 and the carbonate buffering agent is present in a concentration of at least 0.8 molar.

3. A developing solution as claimed in claim 1, wherein the pH is in the range of from 10 to 11 and the carbonate buffering agent is present in a concentration of from 0.9 to 1.5 molar.

4. A developing solution as claimed in claim 1, wherein said developing agent is L-ascorbic acid.

5. A developing solution as claimed in claim 1, wherein said developing agent is D-ascorbic acid.

6. A developing solution as claimed in claim 1, wherein said auxiliary super-additive developing agent is a 3-pyrazolidone.

7. A developing solution as claimed in claim 1, wherein said auxiliary super-additive developing agent is an aminophenol.

8. A developing solution as claimed in claim 1, wherein said auxiliary super-additive developing agent is 1-phenyl-3-pyrazolidone.

9. A developing solution as claimed in claim 1, wherein said auxiliary super-additive developing agent is 1-phenyl-4,4-dimethyl-3-pyrazolidone.

10. A developing solution as claimed in claim 1, wherein said auxiliary super-additive developing agent is 1-phenyl-4-hydroxymethyl-4-methyl-3-pyrazolidone.

11. A developing solution as claimed in claim 1, wherein said auxiliary super-additive developing agent is N-methylaminophenol.

12. A developing solution as claimed in claim 1, wherein said carbonate buffering agent is sodium carbonate.

13. A developing solution as claimed in claim 1, wherein said carbonate buffering agent is potassium carbonate.

14. A developing solution as claimed in claim 1, wherein the amount of said ascorbic acid developing agent is in the range of from 0.1 to 0.3 moles per liter, the amount of said auxiliary super-additive developing agent is in the range of from 0.002 to 0.008 moles per liter, and the amount of said carbonate buffering agent is in the range of from 0.9 to 1.5 moles per liter.

15. A developing solution as claimed in claim 1, additionally containing a sulfite preservative.

16. A developing solution as claimed in claim 1, additionally containing a sulfite preservative in an amount of 0.1 to 0.2 moles per liter.

17. A developing solution as claimed in claim 1, additionally containing sodium sulfite.

18. A developing solution as claimed in claim 1, additionally comprising a benzotriazole antifoggant.

19. A developing solution as claimed in claim 1, additionally containing a bromide.

20. An aqueous alkaline photographic developing solution that is free of dihydroxybenzene developing agents, said developing solution having a pH of about 10.3 and comprising about 0.125 moles per liter of sodium sulfite, about 0.20 moles per liter of L-ascorbic acid, about 2 grams per liter of 1-phenyl-4-hydroxymethyl-4-methyl-3-pyrazolidone, about 0.90 moles per liter of potassium carbonate, about 0.20 grams per liter of benzotriazole and about 6.0 grams per liter of sodium bromide.

* * * * *